US008459640B2

(12) United States Patent
Ui

(10) Patent No.: US 8,459,640 B2
(45) Date of Patent: Jun. 11, 2013

(54) TRANSPORTING DEVICE AND IMAGE FORMING APPARATUS USING THE SAME

(75) Inventor: Makoto Ui, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/465,070

(22) Filed: May 7, 2012

(65) Prior Publication Data

US 2012/0286468 A1 Nov. 15, 2012

(30) Foreign Application Priority Data

May 11, 2011 (JP) ..... 2011-106290

(51) Int. Cl.
*B65H 7/02* (2006.01)

(52) U.S. Cl.
USPC ..... 271/228; 271/242

(58) Field of Classification Search
USPC ..... 271/226, 228, 242
See application file for complete search history.

(56) References Cited

U.S. PATENT DOCUMENTS

| | | | | |
|---|---|---|---|---|
| 5,078,384 | A * | 1/1992 | Moore | 271/228 |
| 5,681,036 | A * | 10/1997 | Wakahara et al. | 271/10.12 |
| 6,059,285 | A * | 5/2000 | Suga et al. | 271/228 |
| 6,817,609 | B2 * | 11/2004 | Halvonik et al. | 271/228 |
| 7,527,263 | B2 * | 5/2009 | DeGruchy et al. | 271/242 |
| 7,819,399 | B2 * | 10/2010 | Choi | 271/228 |
| 2007/0296141 | A1 * | 12/2007 | Inoue | 271/226 |

FOREIGN PATENT DOCUMENTS

| | | |
|---|---|---|
| JP | 2000-335787 | 12/2000 |
| JP | 2007-186291 | 7/2007 |

* cited by examiner

*Primary Examiner* — Jeremy R Severson
(74) *Attorney, Agent, or Firm* — Lucas & Mercanti, LLP

(57) ABSTRACT

A transporting device includes steering rollers, a center roller which is disposed between the steering rollers and deflection-detecting sensors that are positioned downstream from the steering rollers. When a sheet of paper has a width which is narrower than a width of a reference sheet of paper, the positional deflection of the sheet of paper is corrected by transporting the sheet of paper to a shift roller with the sheet of paper being nipped by the center roller and thrusting a forward end of the sheet of paper against a shift roller. When a sheet of paper has a width which exceeds the width of the reference sheet of paper, the positional deflection of the sheet of paper is corrected by rotating the steering rollers separately based on a detected result of the sensors with the sheet of paper being nipped by the steering rollers.

20 Claims, 12 Drawing Sheets

TRANSPORTING DEVICE AND IMAGE FORMING APPARATUS USING THE SAME

CROSS REFERENCES TO RELATED APPLICATIONS

The present invention contains subject matter related to Japanese Patent Application JP 2011-106290 filed in the Japanese Parent Office on May 11, 2011, the entire contents of which being incorporated herein by reference.

BACKGROUND OF THE INVENTION

1. Field of the Invention

The present invention relates to a transporting device that transports a sheet of paper and is equipped with a function of a positional deflection correction for a sheet of transporting paper, and an image forming apparatus using the same.

2. Description of Related Art

An image forming apparatus equipped with multiple functions, which is simultaneously provided with various functions such as a printer, scanner, a copy machine and a facsimile, has been widely used in recent years. In such an image forming apparatus, a sheet of paper may be deflected to an offset position while the sheet of paper is transported because of mechanical factors or the like in the apparatus. In such a case, the sheet of paper is also deflected from an image forming position thereof. Accordingly, a positional deflection correction for correcting the positional deflection of the sheet of paper has been carried out while the sheet of paper is transported.

In order to correct the positional deflection of the sheet of paper, a pair of conveyor rollers is disposed on a width direction of the sheet of paper so that they are away from each other having a predetermined space therebetween. A pair of deflection detection sensors corresponding to the pair of conveyor rollers is also disposed downstream from the conveyor rollers. The conveyor rollers correct the positional deflection of the sheet of paper by adjusting a speed of each conveyor roller based on the periods of time detected by deflection detection sensors at any two points on the sheet of paper.

In the image forming apparatus, various kinds of sheets of paper having different sizes such as A4 size and B5 size are available therefor. When the sheets of paper to be used have different widths which are very different from each other, only one set of the deflection detection sensors and the conveyor rollers as described above is insufficient for the positional deflection correction of each of the sheets of paper.

In other words, when setting the space between the deflection detection sensors or the conveyor rollers to be narrow corresponding to a sheet of paper having a minimum width, it is difficult to detect the sheet of paper sufficiently and to correct the positional deflection of the sheets of paper sufficiently in a case where a sheet of paper having a maximum width is used. Particularly, if the space between the deflection detection sensors is set to be narrow when using a large sized sheet of paper, the deflection detection sensors perform the detection near the middle of the sheet of large-sized paper so that any sufficient detection accuracy is not obtained.

On the contrary, when setting the space between the deflection detection sensors or the conveyor rollers to be wide corresponding to a sheet of paper having a maximum width, it is difficult to detect the sheet of paper sufficiently and to correct the positional deflection of the sheets of paper sufficiently in a case where a sheet of paper having a minimum width is used.

In order to solve such a problem, for example, Japanese Patent Application Publication No. 2000-335787 or 2007-186291 discloses a transporting device and an image forming device using the same in which plural sets of deflection detection sensors and conveyor rollers are disposed along a width direction of the sheet of paper, the rollers positioned on the position of the deflected sheet of paper are selected based on a width size of the sheet of paper detected by the deflection detection sensors, the sheet of paper is transported with it being held between the selected rollers to correct the positional deflection of the sheet of paper.

SUMMARY OF THE INVENTION

However, the past transporting device and the past image forming apparatus, which have been disclosed in Japanese Patent Application Publication No. 2000-335787 or 2007-186291, have a configuration such that a plurality of the deflection detection sensors and conveyor rollers is used for maintaining accuracy of both of a large sized sheet of the paper and a small sized sheet of the paper or the deflection detection sensor having a length over a width direction of the sheet of paper is used. Therefore, many deflection detection sensors and many convey rollers are required or a mechanism for changing nips of the roller is required. Accordingly, the past transporting device and the past image forming apparatus have increased costs therefor. Because a plurality of the deflection detection sensors and conveyor rollers is disposed in the transporting path of the sheet of paper, it is also difficult to design the transporting device and the image forming apparatus for that.

This invention solves the above-mentioned problems and has objects to provide the transporting device which can correct the positional deflection of the sheet of paper with high accuracy independently of any widths of the sheet of paper and the image forming apparatus using the same.

To achieve at least one of the above-mentioned objects, a transporting device reflecting one aspect of the present invention comprises a pair of first roller members which is disposed along a second direction, the second direction being orthogonal to a first direction along which the sheet of paper is transported, and the first roller members being away from each other having a predetermined space therebetween along the second direction; a pair of detection units that detects the sheet of paper passing through positions on which the detection units are disposed, the detection units being positioned downstream from the first roller members along the first direction and being away from each other having a predetermined space therebetween along the second direction; a second roller member that is disposed downstream from the pair of the detection units along the first direction; and a control unit that controls operations of the first and second roller members. In the transporting device, the control unit switches between a first positional deflection correction control of the sheet of paper and a second positional deflection correction control of the sheet of paper based on a length of the sheet of paper along the second direction. The first positional deflection correction control corrects the positional deflection of the sheet of paper by thrusting a forward end of the sheet of paper against the second roller member. The second positional deflection correction control corrects the positional deflection of the sheet of paper by rotating the respective first roller members separately based on periods of time detected by the detection units on the passing sheet of paper.

It is desirable to provide the transporting device wherein the control unit performs the first positional deflection correction control when the length of the sheet of paper along the second direction is shorter than a length of a reference sheet of paper along the second direction, the length of the reference sheet of paper being set previously.

It is desirable to provide the transporting device wherein the length of the reference sheet of paper along the second direction is equal to or longer than a length between the detection units.

It is desirable to provide the transporting device further comprising a transparent body detection unit that detects whether or not the sheet of paper is transparent when the detection units are sensors of transmission type, wherein the control unit performs the first positional deflection correction control when based on the detection result of the transparent body detection unit, the control unit determines that the sheet of paper is transparent.

It is desirable to provide the transporting device further comprising a third roller member which is disposed on a position corresponding to almost a middle of a reference sheet of paper, wherein the control unit drives the third roller member to transport the sheet of paper to the second roller member when performing the first positional deflection correction control.

It is desirable to provide the transporting device wherein each of the first roller members includes a driving roller and a driven roller, the third roller member includes a driving roller and a driven roller, and the control unit releases a contact between the driving roller and the driven roller of each of the first roller members and brings the driven roller of the third roller member coming into contact with the driving roller of the third roller member under pressure when performing the first positional deflection correction control.

It is desirable to provide the transporting device wherein each of the first roller members includes a driving roller and a driven roller, the third roller member includes a driving roller and a driven roller, and the control unit brings the driven roller of each of the first roller members coming into contact with the driving roller of each of the first roller members under pressure and releases a contact between the driving roller and the driven roller of the third roller member when performing the second positional deflection correction control.

It is desirable to provide the transporting device wherein the pair of the roller members is disposed inside both ends of the reference sheet of paper along the second direction, and the control unit drives the first roller members to transport the sheet of paper when performing the first and second positional deflection correction controls.

It is desirable to provide the transporting device wherein the second roller member includes a driving roller and a driven roller, and the control unit performs a third positional deflection correction control of the sheet of paper by moving the second roller member toward the second direction with the sheet of paper being held between the driving roller and the driven roller after the first or second positional deflection correction control is performed.

It is desirable to provide the transporting device wherein each of the first roller members includes a driving roller and a driven roller, the third roller member includes a driving roller and a driven roller, and the control unit releases pressure applied to the driving roller and the driven roller of each of the first roller members and releases pressure applied to the driving roller and the driven roller of the third roller member when performing the third positional deflection correction control.

It is desirable to provide an image forming device including the above-mentioned transporting devices.

On the embodiment of the transporting device according to the invention, if a length of the sheet of paper along the second direction is shorter than the previously set length of the reference sheet of paper along the second direction, it is preferable that the control unit performs the first positional deflection correction control. When various kinds of the sheets of paper having any sizes from a small sized one to a large sited one are used in the image forming apparatus, the length of the reference sheet of paper is set for correcting the positional deflection of the sheets of paper with high accuracy in relation to all of these sheets of paper. For example, in a case of the small sized sheet of paper having a length, along the second direction, which is shorter than the previously set length of the reference sheet of paper, the control unit performs the first positional deflection correction control. In a case of the large sized sheet of paper having a length, along the second direction, which exceeds the previously set length of the reference sheet of paper, the control unit performs the second positional deflection correction control.

It is to be noted that even if a length of the sheet of paper along the second direction exceeds the previously set length of the reference sheet of paper, when the sheet of paper is transparent such as a sheet of paper for overhead projector (OHP), it may be difficult to detect the sheet of paper. In such a case, the control unit may perform the first positional deflection correction control. Thus, by classifying the positional deflection correction controls of the sheet of paper based on the length of the sheet of paper along the second direction, it is possible to perform the positional deflection correction control of the sheet of paper in relation to the large-sized sheet of paper with high productivity and to perform the positional deflection correction control of the sheet of paper steadily in relation to the small-sized sheet of paper. The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

The following will describe embodiments of a transporting device and an image forming apparatus using the same relating to the invention with reference to drawings.

First Embodiment

Configuration Example of Image Forming Apparatus

Figure 1:
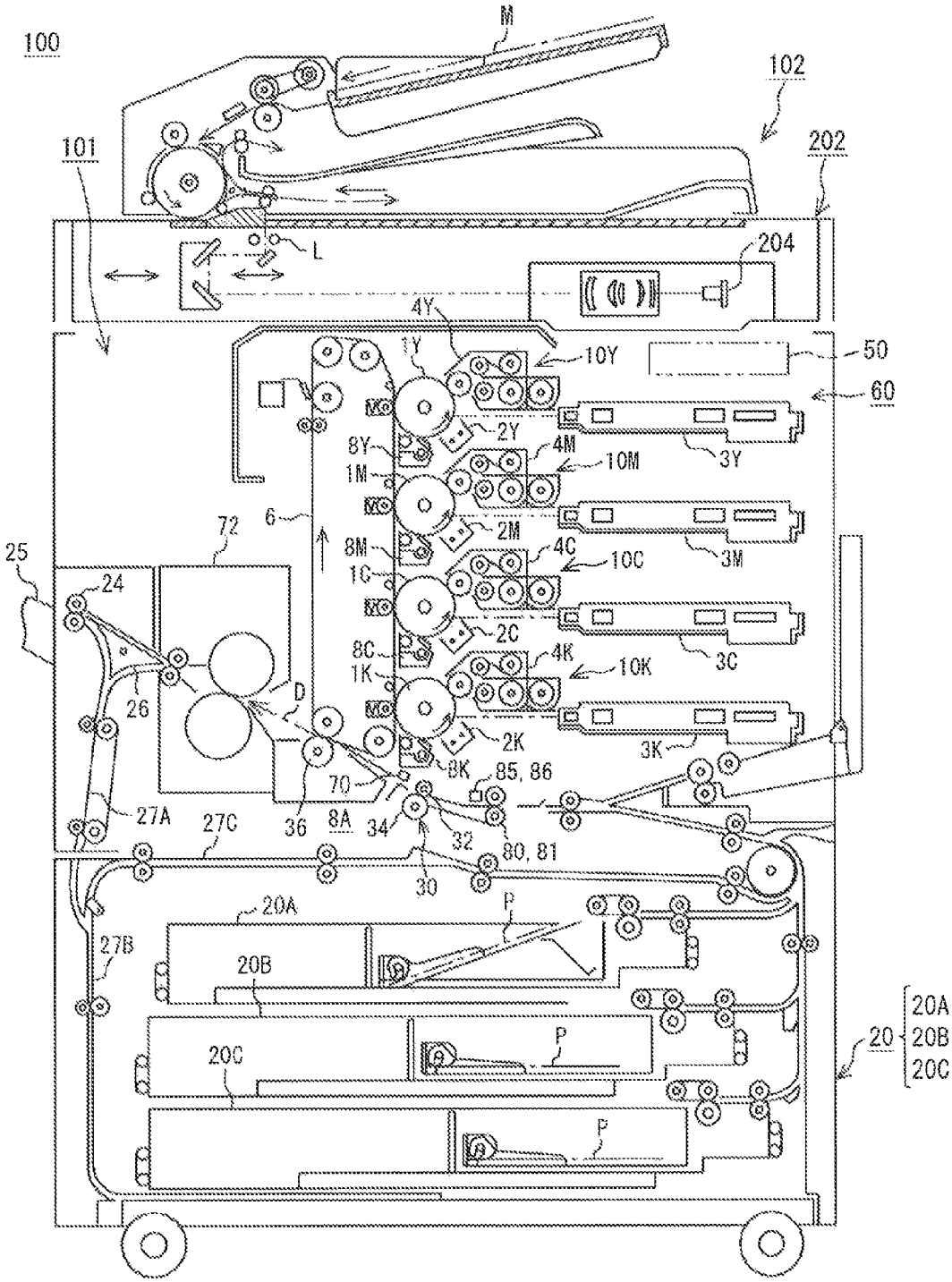
FIG. 1 is a drawing showing a configuration example of an image forming apparatus according to an embodiment of this invention.

FIG. 1 schematically shows a configuration example of the image forming apparatus 100 according to a first embodiment of this invention. The image forming apparatus 100 according to a first embodiment of this invention switches between a first positional deflection correction control of the sheet of paper and a second positional deflection correction control of the sheet of paper based on a length of a sheet of paper P on which an image is formed along a direction (herein after, also referred to as "width direction") which is orthogonal to a transporting direction D1 of the sheet of paper P, specifically based on a width W1 of a reference sheet of paper which is previously set. The width W1 of a reference sheet of paper is a reference width when switching between the first positional deflection correction control of the sheet of paper and the second positional deflection correction control of the sheet of paper. The width W1 of a reference sheet of paper is set to be equal to and longer than a space W4 between deflection-detecting sensors 85, 86, which will be described later (see FIGS. 3A through 3C).

Figure 3A:
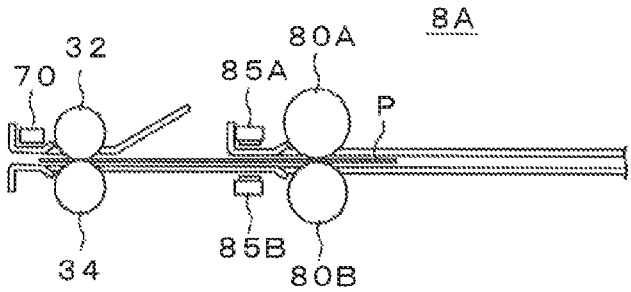
FIG. 3A is a side view of a transporting device according to the first embodiment, seen from a direction which is orthogonal to the transporting direction of the sheet of paper.
Figure 3B:
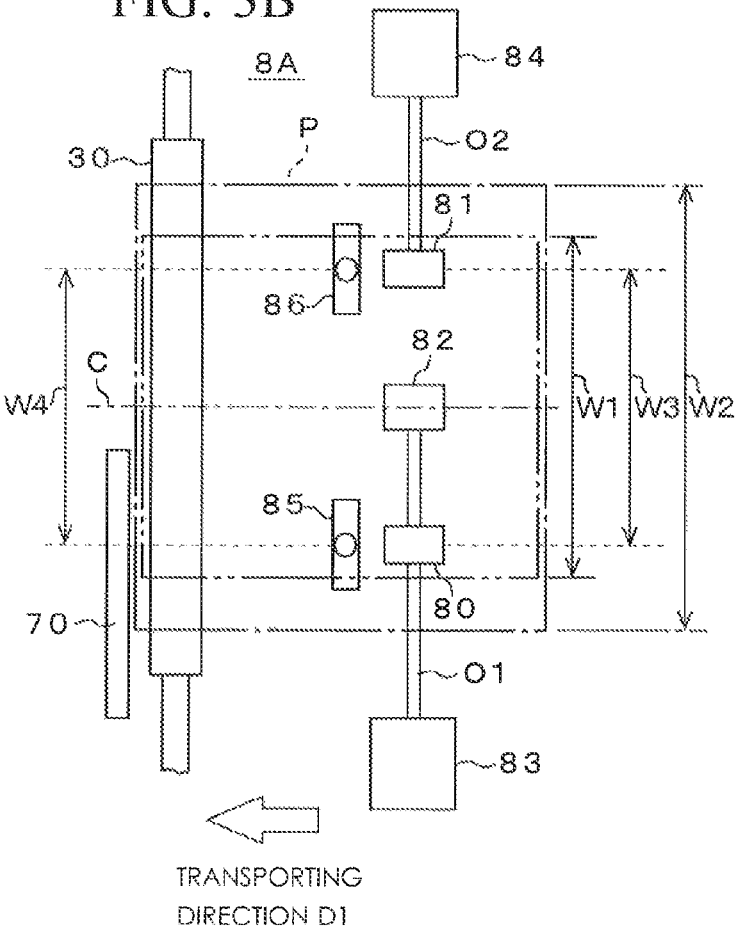
FIG. 3B is a plan view thereof.

The first positional deflection correction control is referred to as "a control to correct the positional deflection of the sheet of paper P by thrusting a forward end of the sheet of paper P against a shift roller 30 to form a loop when a sheet of paper P on which an image is formed has a width which is narrower than a previously set width W1 of a reference sheet of paper" (see FIG. 3B). The second positional deflection correction control is referred to as "a control to correct the positional deflection of the sheet of paper P by rotating the steering rollers 80, 81 separately based on a detected result of the deflection-detecting sensors 85, 86 with a predetermined difference in their speeds to transport the sheet of paper P when a sheet of paper P on which an image is formed has a width which exceeds a previously set width W1 of a reference sheet of paper".

The image forming apparatus 100 is referred to as "an image forming apparatus of tandem type" as shown in FIG. 1. The image forming apparatus 100 contains a main body 101 of the image forming apparatus and an automatic document feeder 102 mounted on the main body 101. The automatic document feeder 102 feeds the documents M, which is mounted on the document mounter, on a one-by-one basis to the main body 101 of the image forming apparatus with them being separated.

The main body 101 of the image forming apparatus contains a document-reading unit 202, image forming units 10Y, 10M, 10C and 10K, an intermediate transfer belt 6, a transporting device 8A, secondary transfer rollers 36, a feeder 20 and a fixing unit 72. The transporting device 8A contains a controller 50, a pair of steering rollers 80, 81, a pair of deflection-detecting sensors 85, 86, the shift roller 30 and a line sensor 70. Further, the image forming units 10Y, 10M, 10C and 10K, the intermediate transfer belt 6 and the secondary transfer rollers 36 constitute an example of an image forming unit 60.

The document-reading unit 202 irradiates light onto an image of the document M at a document image reading position through a lamp L and receives light reflected thereby to focus on an image pickup device 204 such as charge-couple device (CCD) through a mirror unit or the like. The image pickup device 204 receives the light and performs photoelectric conversion thereon to obtain an electric image signal which is output to the controller 50. The controller 50 performs various kinds of processing such as A/D conversion, shading compensation, compression and the like on the image signal to generate any image data.

The image forming unit 10Y contains a charging portion 2Y, an exposing portion 3Y, a developing portion 4Y, a photosensitive drum 1Y and a cleaning portion 8Y. The charging portion 2Y charges a static charge uniformly around a surface of the photosensitive drum 1Y. The exposing portion 3Y is composed of a laser source, polygon mirror, plural lenses and the like, which are not shown. The exposing portion 3Y scans a surface of the photosensitive drum 1Y using laser beam based on the image data received from the controller 50 to form a latent image. The developing portion 4Y develops the latent image on a surface of the photosensitive drum 1Y by using yellow toner Y, thereby forming a toner image. The cleaning portion 8Y cleans the toner leaved on the surface of the photosensitive drum 1Y which has been transferred the toner image.

Other image forming units 10M, 10C and 10K have respectively the same function and configuration as those of the image forming unit 10Y. The developing portions 4M, 4C and 4K develop the latent images on the photosensitive drums 1M, 1C and 1K using magenta toner M, cyan toner C and black toner K respectively to affix them to form the latent images on the photosensitive drums 1M, 1C and 1K as their toner images. Respective toner images formed on the photosensitive drains 1Y, 1M, 1C and 1K are transferred to the endless intermediate transfer belt 6 so that the images are overlapped at their predetermined locations, thereby forming a color image on the intermediate transfer belt 6.

The feeder 20 is provided with plural feeding trays 20A, 20B and 20C. The feeder 20 sends the sheet of paper P, which is selected by a user, from any of the feeding trays 20A, 20B and 20C by the conveyor rollers and transports it to the steering rollers 80, 81.

The deflection-detecting sensors 85, 86 are positioned downstream from the steering rollers 80, 81 along the transporting direction D1 and detect, for example, periods of time when the sheet of paper passes therethrough. In the second positional deflection correction control of the sheet of paper, the respective steering rollers 80, 81 separately rotate with a difference in their speeds based on the periods of time when the sheet of paper passes therethrough, which is detected by the deflection-detecting sensors 85, 86, to transport the sheet of paper P, thereby performing the positional deflection correction of the sheet of paper P.

The shift roller 30 is positioned downstream from the steering rollers 80, 81 along the transporting direction D1 and, in the first positional deflection correction control of the sheet of paper, perform a positional deflection correction of the sheet of paper P by thrusting a forward end of the sheet of paper P fed from the feeder 20 against it so that the sheet of paper P is looped. The shift roller 30 also moves to the width direction of the sheet of paper P with the sheet of paper being nipped by it by a difference (a deviated amount) which is an amount deviated from a normal image forming position of the sheet of paper P based on a detected result of the sheet of paper P by the line sensor 70 which is positioned downstream from the shift rollers 30 along the transporting direction D1 of the sheet of paper P, thereby correcting the deviation correction of the sheet of paper P.

The sheet of paper P, a position of which has been corrected by the shift rollers 30, is transported to the secondary transfer portion at a fixed timing. The sheet of paper P is brought into contact with the intermediate transfer belt 6 and a color image formed by overlapping respective toner images on the intermediate transfer belt 6 is transferred to the sheet of paper P. The sheet of paper P to which the color image is transferred is transported to the fixing portion 72 by the secondary transfer rollers 36 or the like. The fixing portion 72 contains a heater and fixes the color image (non-toner image) on the sheet of paper P by applying pressure to the sheet of paper P and/or heating the same. The fixed sheet of paper P is ejected by paper ejection rollers 24 to a paper ejection tray 25.

When images are formed on both sides of the sheet of paper P, the sheet of paper P, on a surface of which the image has already been formed, is transported into a loop path 27A via diverging paths 26, inverted in the inverting portion 27B and then, transported to the secondary transfer portion again via a re-feeding path 27C. In the secondary transfer portion, the other color image is transferred to a back surface of the sheet of paper P and then, ejected to the paper ejection tray 25 via the fixing unit 72.

Configuration Example of Transporting Device

Figure 2:
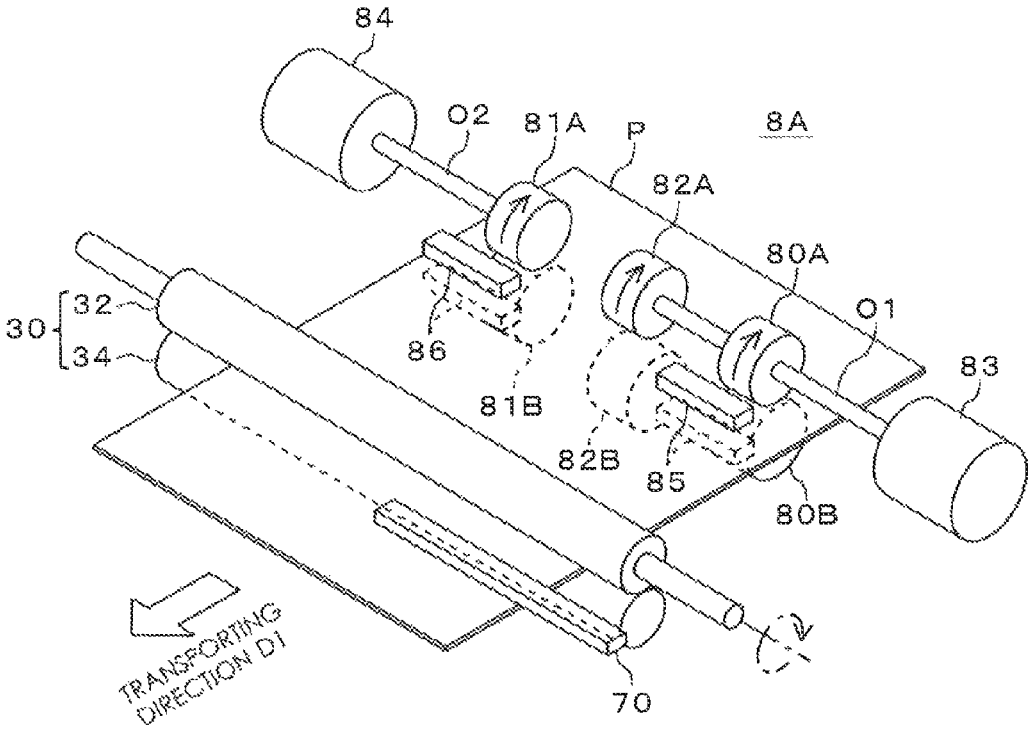
FIG. 2 is a perspective view of a transporting device showing a configuration example thereof.
Figure 3C:
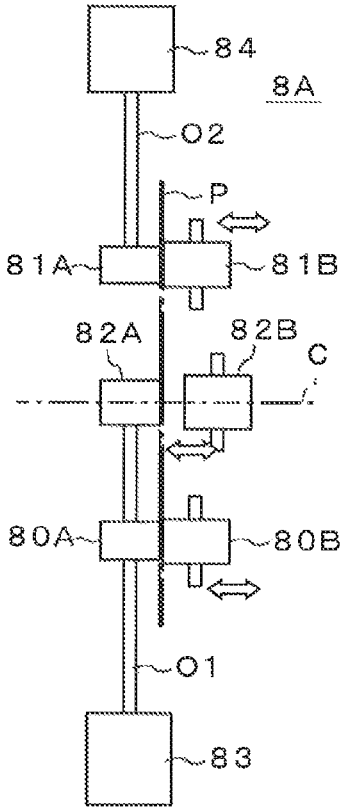
FIG. 3C is a front view thereof, seen from a direction which is parallel to the transporting direction of the sheet of paper.

FIG. 2 shows a configuration example of the transporting device 8A. FIG. 3A shows a side view of the transporting device 8A, seen from a direction which is orthogonal to the transporting direction D1 of the sheet of paper P. FIG. 3B shows a plan view thereof. FIG. 3C shows a front view thereof, seen from a direction which is parallel to the transporting direction D1 of the sheet of paper P. As shown in FIGS. 2 through 3C, the transporting device 8A is provided with a pair of the steering rollers 80, 81, a center roller 82, steering-roller-driving motors 83, 84, a pair of the deflection-defecting sensors 85, 86, the shift rollers 30 and the line sensor 70. The steering rollers 80, 81 constitute first roller members. The center roller 82 constitutes a third roller member. The shift roller 30 constitutes a second roller member. The deflection-detecting sensors 85, 86 constitute detection units.

The steering rollers 80, 81 are rollers mainly used when performing the second positional deflection correction control of the sheet of paper P. The steering rollers 80, 81 are away from each other having a predetermined space W3 therebetween along the width direction of the sheet of paper P in symmetry of a center criterion C of the transporting path of the sheet of paper P. Specifically, a width W1 of the reference sheet of paper, a width W2 of the sheet of paper specified as the maximum size among the sheets of paper used in the image forming apparatus 100 and the space W3 between the steering rollers 80, 81 have a relationship of W3<W1<W2. This is because if W1 is set to be W3, an unstable case where only one steering roller holds the sheet of paper P or both of the steering rollers 80, 81 hold merely small areas of the sheet of paper P occurs when the sheet of paper P is transported to the steering rollers 80, 81 while the sheet of paper P is deflected and/or deviated. In this embodiment, in order to keep a room to hold the sheet of paper P surely by both of the steering rollers 80, 81 even when transporting the sheet of paper P while the sheet of paper P is somewhat deflected or deviated, the space W3 between the steering rollers 80, 81 is set to be W1>W3. This enables the large size sheet of paper P (the sheet of paper P having the maximum width W2) which exceeds the width W1 of the reference sheet of paper P to be nipped by the steering rollers 80, 81 surely to correct the positional deflection of sheet of paper P. The width W1 of the reference sheet of paper is a width of the sheet of paper as a criterion when switching between the first positional deflection correction control of the sheet of paper and the second positional deflection correction control of the sheet of paper. The width W1 of the reference sheet of paper is previously set. As a specific example, in this embodiment, when setting the width W1 of the reference sheet of paper P to be 160 mm, it is preferable that the space W3 between the steering rollers 80, 81 is, for example, about 140 mm. It is also preferable that a length of each of the steering rollers 80, 81 along an axis direction thereof is, for example, about 10 mm.

The steering roller 80 includes a steering-roller-driving roller 80A and a steering-roller-driven roller 80B as shown in FIGS. 3A and 3C. The steering-roller-driven roller 80B comes into contact with the steering-roller-driving roller 80A under pressure or releases the contact with it by a steering-roller-contacting mechanism 87, which will be described. The steering roller 81 has a configuration similar to that of the steering roller 80. Under these configurations, the steering rollers 80, 81 nip the sheet of paper P in the second positional deflection correction control of the sheet of paper. The steering rollers 80, 81 then transport the sheet of paper P which has a width that is wider than the width W1 of the reference sheet of paper with the sheet of paper P being nipped and the respective steering rollers 80, 81 rotate separately based on periods of (passed) time of the sheet of paper P detected by the deflection-detecting sensors 85, 86 to perform the positional deflection correction of the sheet of paper P.

The center roller 82 is a roller used when performing the first positional deflection correction control of the sheet of paper P. The center roller 82 is attached to a forward portion of a rotation axle O1 of the steering roller 80 and is positioned on the center criterion C (near the middle of the reference sheet of paper having the width W1). The center roller 82 includes a center-roller-driving roller 82A and a center-roller-driven roller 82B as shown in FIGS. 3A and 3C. The center-roller-driven roller 82B comes into contact with the center-roller-driving roller 82A under pressure or releases the contact with it by a center-roller-contacting mechanism 88, which will be described. Under these configurations, the center roller 82 nips the sheet of paper P in the first positional deflection correction control of the sheet of paper. The center roller 82 then transports the sheet of paper P which has a width that is narrower than the width W1 of the reference sheet of paper to the shift roller 30 with the sheet of paper P being nipped.

The steering-roller-driving motor 83 connects the steering-roller-driving roller 80A of the steering roller 80 and the center-roller-driving roller 82A of the center roller 82, respectively, via the rotation axle O1. The steering-roller-driving motor 83 is driven under the control of the controller 50 to rotate tire steering-roller-driving roller 80A and the center-roller-driving roller 82A in the first and second positional deflection correction controls of the sheet of paper. The steering-roller-driving motor 84 connects a steering-roller-driving roller 81A of the steering roller 81 via a rotation axle O2. The steering-roller-driving motor 84 is driven under the control of the controller 50 to rotate the steering-roller-driving roller 81A in the first and second positional deflection correction controls of the sheet of paper. These respective steering-roller-driving motors 83, 84 are separately driven in the second positional deflection correction control of the sheet of paper on the basis of an amount of positional deflection of the sheet of paper P which is calculated from a difference in the periods of passed time of the sheet of paper P detected by the deflection-detecting sensors 85, 86 and the transporting speed of the sheet of paper P.

The deflection-detecting sensors 85, 86 are positioned downstream from the steering rollers 80, 81 along the transporting direction D1 of the sheet of paper P and are away from each other halving a predetermined space W3 therebetween along a direction that is orthogonal to the transporting direction D1 of the sheet of paper P in symmetry of the center criterion C of the transporting path of the sheet of paper P. The deflection-detecting sensors 85, 86 are disposed in a region within the width W1 of the reference sheet of paper in order to surely detect the sheet of paper P having a width which is wider than the width W1 of the reference sheet of paper. Preferably, each of the deflection-detecting sensors 85, 86 is disposed on a position of the transporting path of the sheet of paper P, which is on an identical line on which each of the steering rollers 80, 81 is disposed along the transporting direction D1 of the sheet of paper P. Each of the deflection-detecting sensors 85, 86 is composed of a pair of sensors of transmission type which are positioned over and blow the transporting path of the sheet of paper P with them being opposed, as shown in FIG. 3A. The deflection-detecting sensors 85, 86 detect periods of time at two points on the sheet of paper P when the sheet of paper P is passed through the deflection-detecting sensors 85, 86, in the second positional deflection correction control of the sheet of paper.

The shift roller 30 is positioned downstream from the deflection-detecting sensors 85, 86 in the transporting path of the sheet of paper P and the shift roller 30 is positioned, so that a longitudinal direction thereof extends along a direction that is orthogonal to the transporting direction D1 of the sheet of paper P. The shift roller 30 includes a driving roller 32 and a driven roller 34 as shown in FIGS. 3A and 3C. The driven roller 34 comes into contact with the driving roller 32 under pressure or releases the contact with it by a shift-roller-contacting mechanism 44, which will be described. Thus, the shift roller 30 performs a correction of the sheet of deflected paper P in the first positional deflection correction control of the sheet of paper by thrusting a forward end of the sheet of transporting paper P against it so that the sheet of paper P is looped. After the first or second positional deflection correction controls of the sheet of paper has been performed, the shift roller 30 moves the sheet of paper P to a direction that is orthogonal to the transporting direction D1 of the sheet of paper P with the sheet of paper P being nipped, thereby performing the third positional deflection correction control of the sheet of paper, namely, the deviation correction of the sheet of paper P.

The line sensor 70 is composed of plural image pickup devices such as CCD, which are arranged so as to be put side by side. An arranged direction thereof extends along a direction that is orthogonal to the transporting direction D1 of the sheet of paper P. The line sensor 70 is positioned downstream from the shift roller 30 along the transporting direction D1 of the sheet of paper P and is also arranged so as to extend beyond at least a side end of the sheet of paper P on the orthogonal direction thereof. The line sensor 70 detects a position of the side end of the sheet of paper P which has been passed through the shift roller 30.

A transparent-body-detecting sensor 90 constitutes a transparent body detection unit. It is preferable that the transparent-body-detecting sensor 90 is positioned upstream to the center roller 82 along the transporting direction D1 and is also positioned within the width of the sheet of paper P having the minimum width. The transparent-body-detecting sensor 90 is composed of, for example, a sensor of reflection type and detects whether or not the sheet of paper being transported is a sheet of paper P made of transparent material such as a sheet of paper for OHP. If the sheet of paper is transparent, the transparent-body-detecting sensor 90 supplies a detection signal to the controller 50.

Configuration Example of Image Forming Apparatus

Figure 4:
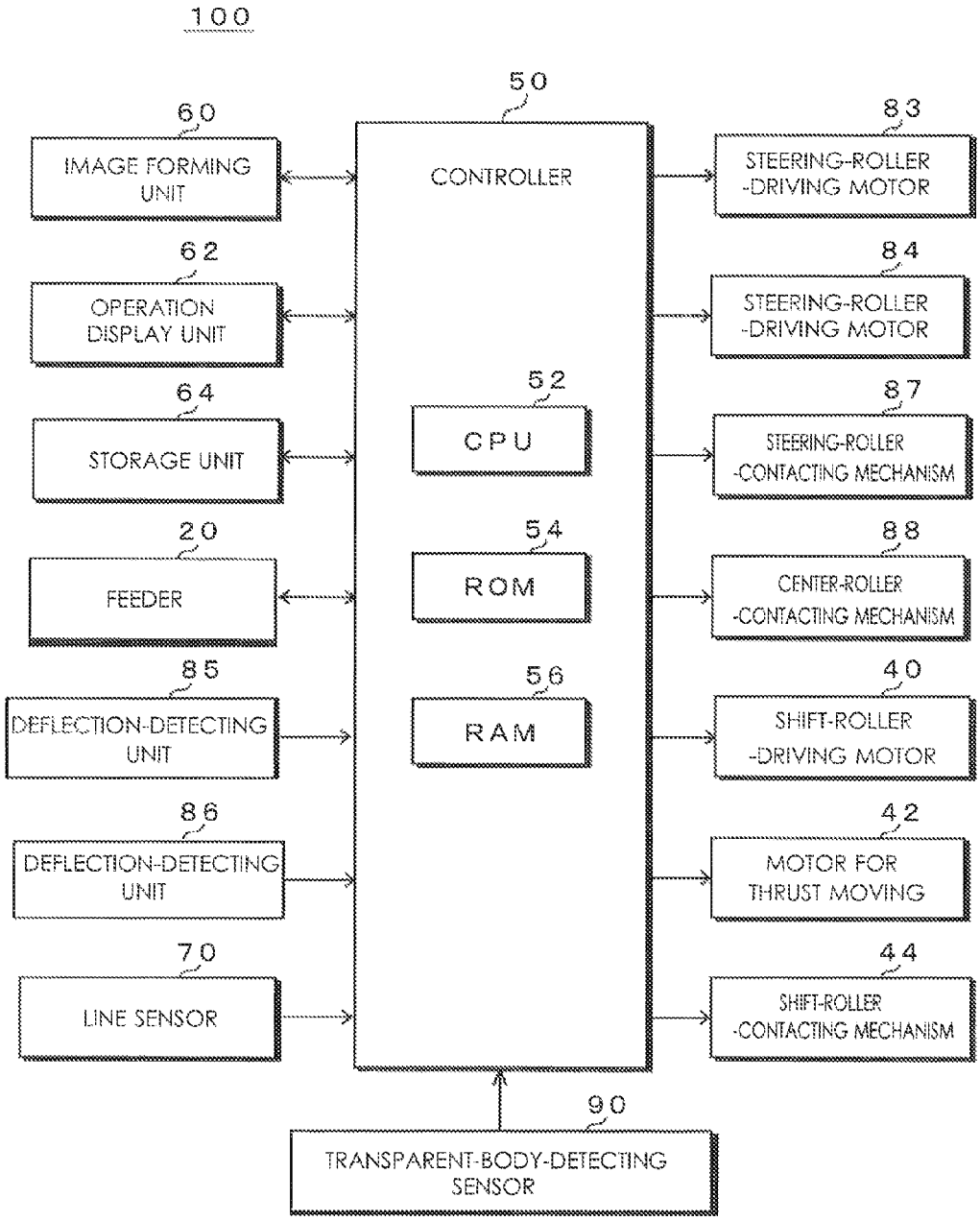
FIG. 4 is a block diagram illustrating a configuration example of the image forming apparatus.

FIG. 4 illustrates a configuration example of the image forming apparatus 100. As shown in FIG. 4, the image forming apparatus 100 contains a controller controlling an operation of whole of the image forming apparatus 100. The controller 50 includes a central processing unit (CPU) 52, a read only memory (ROM) 54, a random access memory (RAM) 56 and the like. CPU 52 performs image forming processing and/or the first, second and third positional deflection correction controls of the sheet of paper by reading any programs stored in ROM 54 and extracting the programs to precede them.

The controller 50 connects an image forming unit 60, an operation display unit 62, a storage unit 64, the feeder 20, the deflection-detecting sensors 85, 86, the line sensor 70, the steering-roller-driving motors 83, 84, the steering-roller-contacting mechanism 87, the center-roller-contacting mechanism 88, a shift-roller-driving motor 40, a motor 42 for thrust moving, a shift-roller-contacting mechanism 44 and the transparent-body-detecting sensor 90, respectively.

The operation display unit 62 is composed of, for example, a touch panel of capacitive sensing system or resistive film system. The operation display unit 62 detects input information based on any input operations by a user and supplies an operation signal to the controller 50. For example, the operation display unit 62 receives any information for a size of the sheet of paper input by the user and receives various kinds of conditions of image forming processing to supply the operation signals based on these pieces of input information to the controller 50.

The storage unit 64 is composed of, for example, a semiconductor memory, a hard disk drive (HDD) and the like. The storage unit 64 stores, for example, a table in which sizes of the sheets of paper and widths of the sheets of paper corresponding to the sizes thereof are listed and any information on the width of the reference sheet of paper which is a criterion when choosing between the first and second positional deflection correction controls of the sheet of paper.

The image forming unit 60 is provided with, for example, the intermediate transfer belt 6 and the like and performs any image forming processing based on the control information received from the controller 50. The feeder 20 feeds to the image forming unit 60 the sheet of paper P which has a size corresponding to any paper-size information input in the operation display unit 62 or the like.

The deflection-detecting sensor 85 is composed of, for example, a sensor of transmission type. The deflection-detecting sensor 85 detects the sheet of paper P passing through the deflection-detecting sensor 85 in the second positional deflection correction control of the sheet of paper and supplies a detected signal to the controller 50. Similarly, the deflection-detecting sensor 86 is composed of, for example, a sensor of transmission type. The deflection-detecting sensor 86 detects the sheet of paper P passing through the deflection-detecting sensor 86 in the second positional deflection correction control of the sheet of paper and supplies a detected signal to the controller 50. This enables to be detected the periods of time at two points of the forward end of the sheet of paper P along the width direction of the sheet of paper P when the sheet of paper P passes through the deflection-detecting sensors 85, 86. It is to be noted that in the first positional deflection correction control of the sheet of paper, the deflection-detecting sensors 85, 86 are not used for the detection.

The line sensor 70 detects the side end of the sheet of paper P transported to the secondary transfer portion from the shift rollers 30 and supplies to the controller 50 a detection signal obtained by this detection.

The steering-roller-driving motor 83 drives the steering roller 80 and the center roller 82 on the basis of the driving signal received from the controller 50 to rotate the steering roller 80 and the center roller 82 when performing the first and second positional deflection correction controls of the sheet of paper.

The steering-roller-driving motor 84 drives the steering roller 81 on the basis of the driving signal received from the controller 50 to rotate the steering roller 81 when performing the second positional deflection correction control of the sheet of paper. The steering-roller-driving motor 84 also rotates the steering roller 81 at a speed that is the same as the speed of the steering roller 80 when performing the first positional deflection correction control of the sheet of paper. This is because if the steering roller 81 remains stopped, the sheet of paper P transported contacts the steering roller 81 so that a stable transportation of the sheet of paper may be impossible. It is to be noted that the center roller 82 may connect the steering-roller-driving motor 84 which the steering roller 81 connects via the rotation axle O2 or may connect a driving motor, which is separately disposed, to be rotated.

The steering-roller-contacting mechanism 87 is composed of, for example, a solenoid, a motor and the like. The steering-roller-contacting mechanism 87 allows the steering-roller-driven rollers 80B, 81B to come into contact with the steering-roller-driving rollers 80A, 81A under pressure or allows the contact of them to be released. This enables the sheet of paper P which has a width exceeding the width W1 of the reference sheet of paper to be transported with the sheet of paper P being nipped by the steering rollers 80, 81 when performing the second positional deflection correction control of the sheet of paper.

The center-roller-contacting mechanism 88 is composed of, for example, a solenoid, a motor and the like. The center-roller-contacting mechanism 88 allows the center-roller-driven roller 82B to come into contact with the center-roller-driving roller 82A under pressure or allows the contact of them to be released. This enables the sheet of paper P which has a width that is narrower than the width W1 of the reference sheet of paper to be transported with the sheet of paper P being nipped by the center roller 82 when performing the first positional deflection correction control of the sheet of paper.

The shift-roller-driving motor 40 is composed, of, for example, a stepping motor or the like. The shift-roller-driving motor 40 drives the shift roller 30 based on a driving signal received from the controller 50 to rotate or stop the shift roller 30. This enables a positional deflection of the sheet of paper P to be corrected by thrusting the sheet of paper P against the shift roller 30 to form a loop.

The motor 42 for thrust moving is composed of, for example, a stepping motor or the like. The motor 42 for thrust moving drives the shift roller 30 based on a driving signal received from the controller 50 to move the shift roller 30 to a direction that is orthogonal to the transporting direction D1 of the sheet of paper P through any driving transmission means such as gear mechanism. This enables the sheet of paper P to move to a normal image forming position so that the positional deflection, namely, deviation of the sheet of paper P is corrected.

The shift-roller-contacting mechanism 44 is composed of, for example, a solenoid, a motor and the like. The shift-roller-contacting mechanism 44 allows the driven roller 34 to come into contact with the driving roller 32 under pressure or allows the contact of them to be released. This enables the sheet of paper P on which the first and second positional deflection correction controls of the sheet of paper P have been performed to move to the direction which is orthogonal to the transporting direction D1 of the sheet of paper P with the sheet of paper P being nipped by the shift roller 30.

The controller 50 determines to perform the first positional deflection correction control of the sheet of paper or to perform the second positional deflection correction control of the sheet of paper based on the width of the sheet of paper P selected by, for example, the operation display unit 62. When performing the first positional deflection correction control of the sheet of paper, the controller 50 controls the center-roller-contacting mechanism 88 so that the center-roller-driven roller 82B comes into contact with the center-roller-driving roller 82A under pressure and controls the steering-roller-contacting mechanism 87 to release the contact between the steering-roller-driving rollers 80A, 81A and the steering-roller-driven rollers 80B, 81B. The controller 50 then drives the steering-roller-driving motor 88 to rotate the center roller 82, thereby transporting the sheet of paper P having a width which is narrower than the width W1 of the reference sheet of paper to the shift roller 30 with the sheet of paper P being nipped. Accordingly, the positional deflection of the sheet of paper P is corrected by thrusting the forward end of the sheet of paper P against the shift roller 30 to form a loop.

When performing the second positional deflection correction control of the sheet of paper, the controller 50 controls the steering-roller-contacting mechanism 87 so that the steering-roller-driven rollers 80B, 81B comes into contact with the steering-roller-driving rollers 80A, 81A under pressure and controls the center-roller-contacting mechanism 88 to release the contact between the center-roller-driving roller 82A and the center-roller-driven roller 82B. The controller 50 then calculates an amount of positional deflection of the sheet of paper P from the difference in the periods of passed time of the sheet of paper P detected by the deflection-detecting sensors 85, 86 and the transporting speed of the sheet of paper P. The controller 50 calculates operations of a pair of the steering rollers 80, 81 based on the amount of positional deflection of the sheet of paper P thus calculated. The controller 50 then controls both of the steering rollers 80, 81 or either of them to change their rotation speed separately, thereby moving the sheet of paper P to correct the positional deflection of the sheet of paper P.

Further, after the first or second positional deflection correction control of the sheet of paper has been performed, the controller 50 determines to perform the third positional deflection correction control of the sheet of paper. The controller 50 calculates a difference between the position of the side end of the sheet of paper P detected by the line sensor 70 and a previously set normal image forming position in which an image is formed in the image forming unit 60. The controller 50 then controls the shift roller 30 to move with the sheet of paper P being nipped toward a direction which is orthogonal to the transporting direction D1 by the difference obtained by the calculation to correct the positional deflection of the sheet of paper P, namely, the deviation of the sheet of paper P.

Example of Operation of Controller in Image Forming Apparatus

Figure 5:
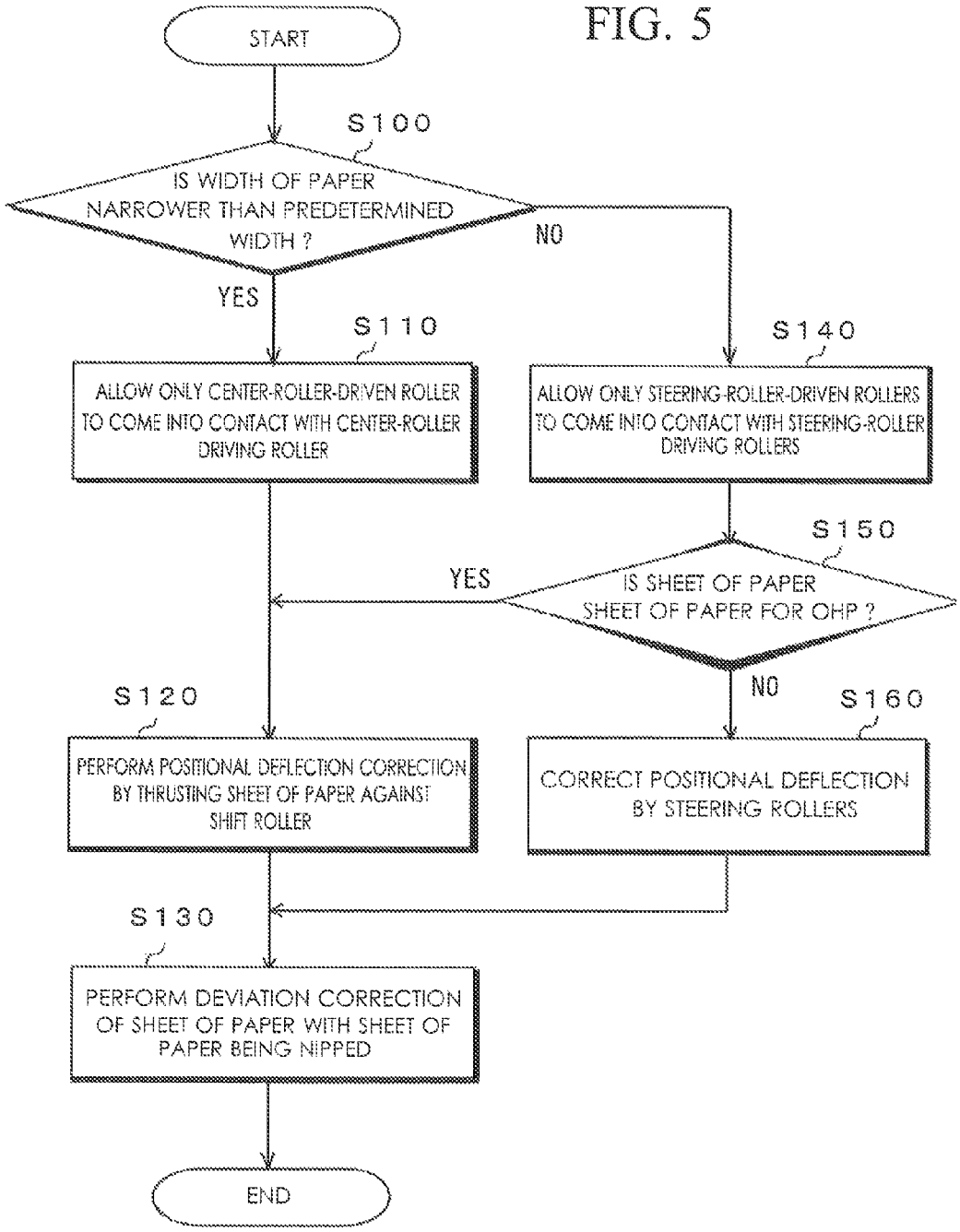
FIG. 5 is a flowchart showing an operation example of the image forming apparatus.

The following will describe an operation of the controller 50 in this embodiment of the image forming apparatus 100. FIG. 5 shows an operation example of the controller 50 in the image forming apparatus 100. FIGS. 6 through 11 show operation example of the transporting device 8A.

As shown in FIG. 5, at Step S100, the controller 50 determines if a width of a sheet of paper P on which an image is formed is narrower than the width W1 of the reference sheet of paper which is previously set. For example, when the width of the sheet of paper P is obtained from a size of sheet of paper selected by the user in the operation display unit 62, the controller 50 compares the width of the sheet of paper P thus obtained with the width W1 of the reference sheet of paper to determines if the width of the sheet of paper P on which an image is formed is narrower than the width W1 of the reference sheet of paper.

If the controller 50 determines that the width of the sheet of paper P is narrower than the previously set width W1 of the reference sheet of paper, then the controller 50 goes to Step S110 where the first positional deflection correction control of the sheet of paper is performed. If not, then the controller 50 goes to Step S140 where the second positional deflection correction control of the sheet of paper is performed.

Figure 6A:
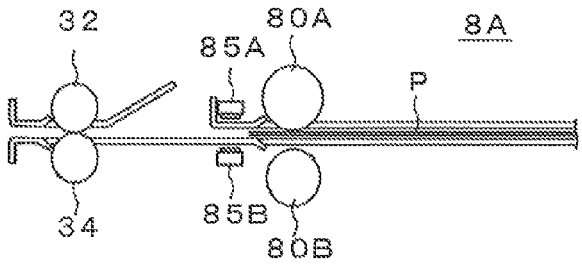
FIG. 6A is a side view of a transporting device according to the first embodiment, seen from a direction which is orthogonal to the transporting direction of the sheet of paper.
Figure 6B:
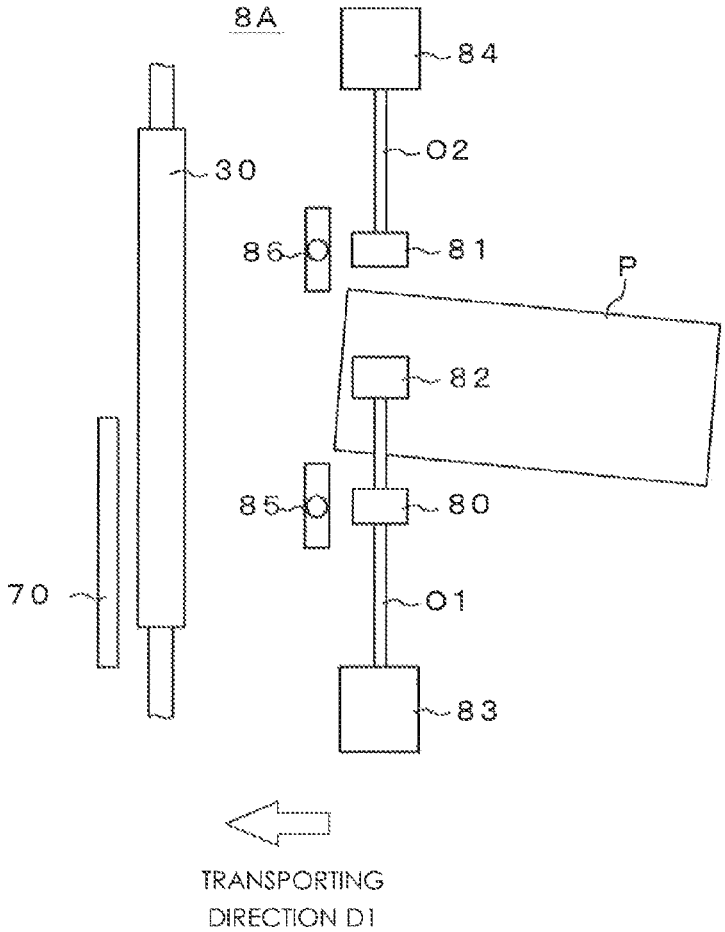
FIG. 6B is a plan view thereof.
Figure 6C:
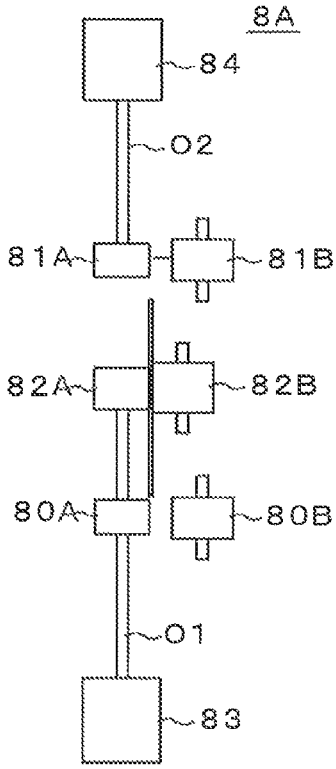
FIG. 6C is a front view thereof, seen from a direction which is parallel to the transporting direction of the sheet of paper, these drawings showing operation example of the transporting device when performing the first positional deflection correction control (part one)

At the Step S110, the controller 50 allows only the center-roller-driven roller 82B to come into contact with the center-roller-driving roller 82A under pressure in the first positional deflection correction control of the sheet of paper. Specifically, as shown in FIG. 6C, the controller 50 controls the center-roller-contacting mechanism 88 so that the center-roller-driven roller 82B comes into contact with the center-roller-driving roller 82A under pressure and controls the steering-roller-contacting mechanism 87 to release the contact between the steering-roller-driving rollers 80A, 81A and the steering-roller-driven rollers 80B, 81B. This enables the sheet of paper P to be nipped by the center-roller-driving roller 82A and the center-roller-driven roller 82B, as shown in FIGS. 6A through 6C. Under this condition, the controller 50 drives the steering-roller-driving motor 83 to rotate the center roller 82 and to transport the sheet of paper P to the shift roller 30. The controller 50 then goes to Step S120.

Figure 7A:
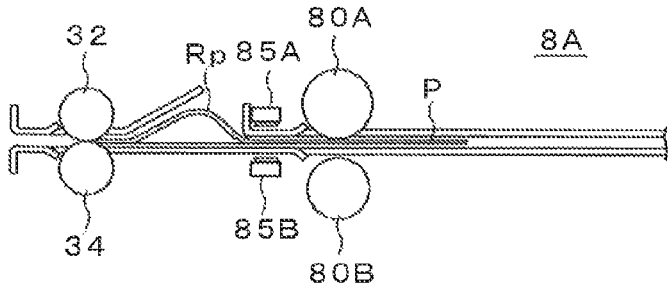
FIG. 7A is a side view of the transporting device according to the first embodiment, seen from a direction which is orthogonal to the transporting direction of the sheet of paper.
Figure 7B:
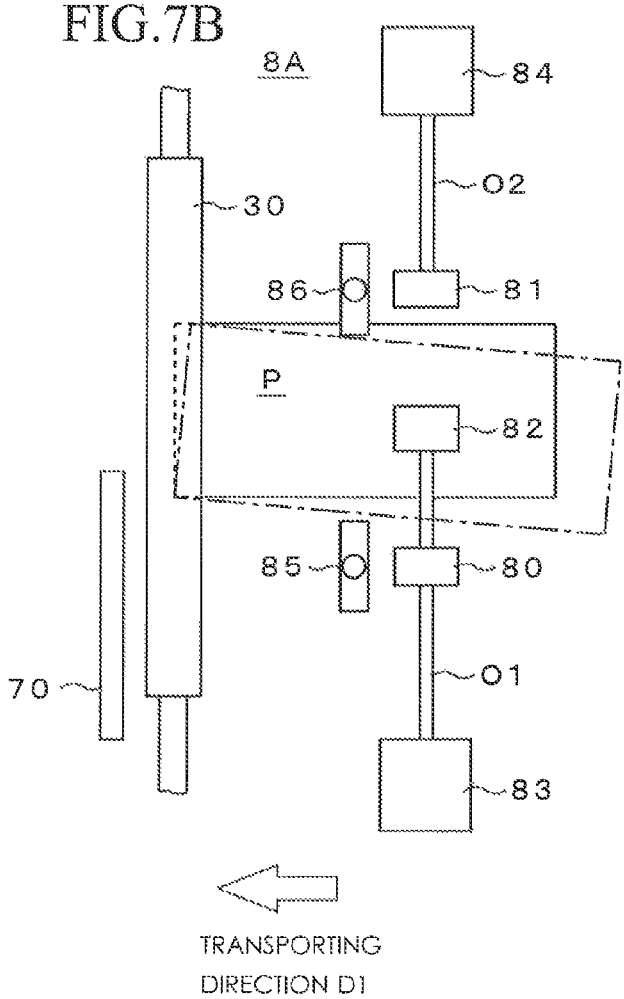
FIG. 7B is a plan view thereof.
Figure 7C:
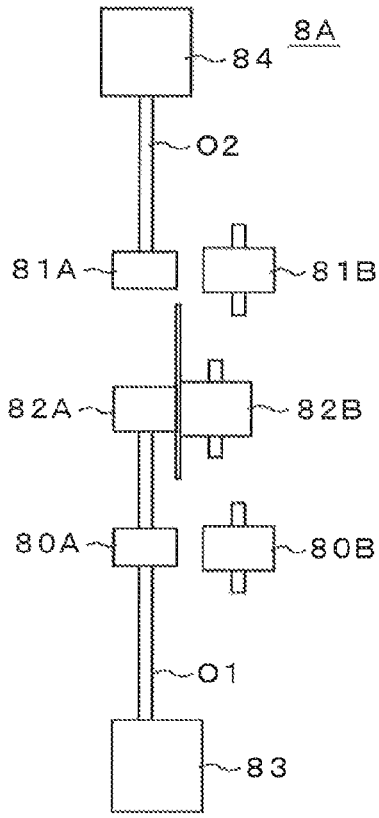
FIG. 7C is a front view thereof, seen from a direction which is parallel to the transporting direction of the sheet of paper, these drawings showing operation example of the transporting device when performing the first positional deflection correction control (part two)

At the step S120, the controller 50 performs the positional deflection correction of the sheet of paper P by thrusting the sheet of paper P against the shift roller 30. As shown in FIGS. 7A through 7C, the controller 50 allows the center-roller-driven roller 82B to come into contact with the center-roller-driving roller 82A under pressure and drives the steering-roller-driving motor 83 to transport the sheet of paper P to the shift roller 3. After the forward end of the sheet of paper P has been thrust to the shift roller 30, the controller 50 controls the steering-roller-driving motor 83 to slow down gradually and to stop for a predetermined period of time, thereby forming the loop Rp to perform the positional deflection correction of the sheet of paper P (see FIG. 7A). The controller 50 then goes to Step S130.

Figure 8A:
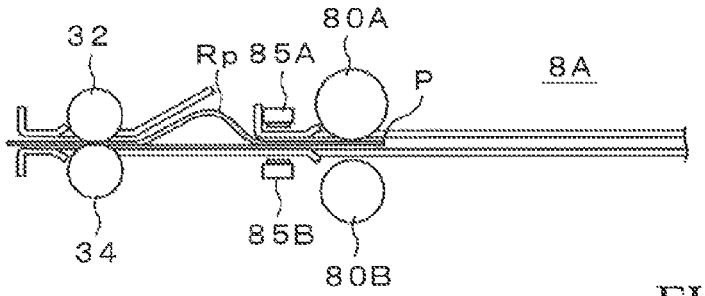
FIG. 8A is a side view of a transporting device according to the first embodiment, seen from a direction which is orthogonal to the transporting direction of the sheet of paper.
Figure 8B:
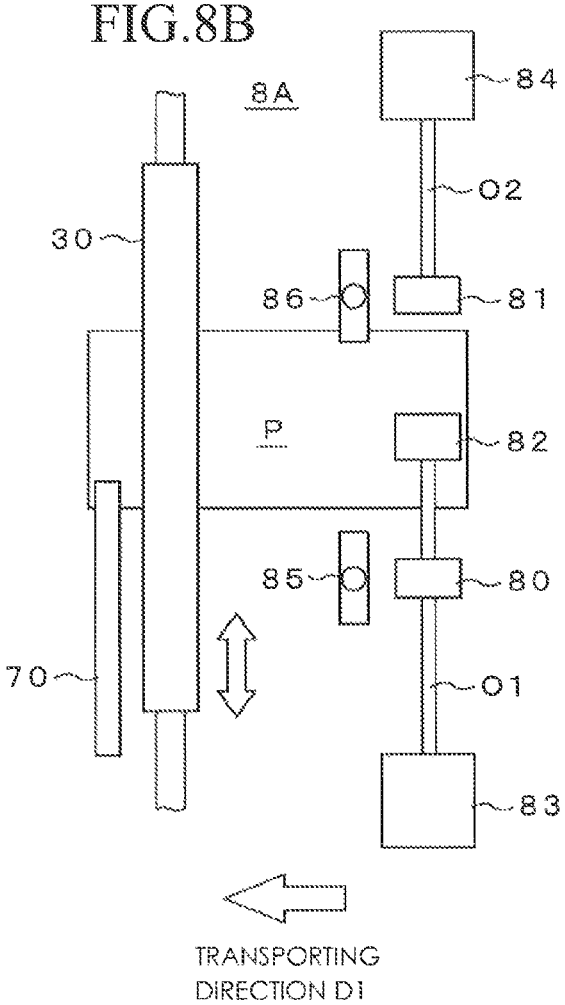
FIG. 8B is a plan view thereof.
Figure 8C:
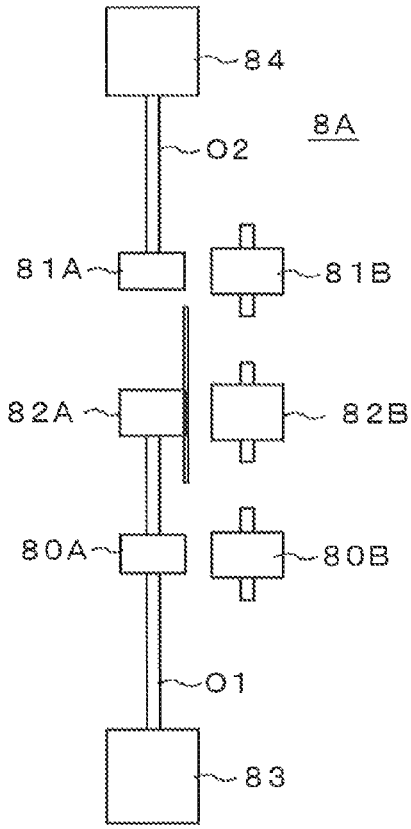
FIG. 8C is a front view thereof, seen from a direction which is parallel to the transporting direction of the sheet of paper, these drawings showing operation example of the transporting device when performing the first positional deflection correction control (part three)

At the step S130, when the first positional deflection correction control of the sheet of paper is finished, the controller 50 performs the third positional deflection correction control of the sheet of paper, namely, deviation correction control of the sheet of paper P. The controller 50 restarts driving the steering-roller-driving motor 83 to transport the sheet of paper P to the shift roller 30. The controller 50 controls the shift roller 30 to nip the sheet of paper P and then, stops driving the steering-roller-driving motor 83. As shown in FIG. 8C, the controller 50 controls the center-roller-contacting mechanism 38 to release the contact between the center-roller-driving roller 82A and the center-roller-driven roller 82B. This enables the contact between the center-roller-driving roller 82A and the center-roller-driven roller 82B to be released and enables the contact between the steering-roller-driving rollers 80A, 81A and the steering-roller-driven rollers 80B, 81B to be released. When releasing the contacts therebetween, the controller 50 calculates an amount of deviation of the sheet of paper P in relation to the normal image forming position based on the detected result of the line sensor 70 and controls the shift roller 30 to move along a width direction of the sheet of paper P based on the calculated amount of deviation of the sheet of paper P, thereby correcting the deviation of the sheet of paper P.

Figure 9A:
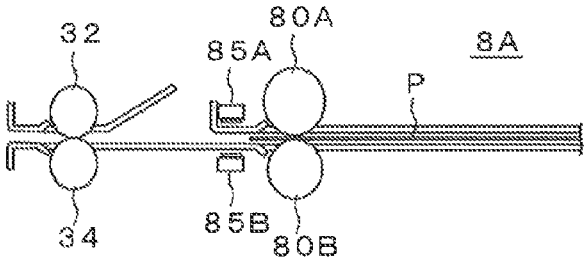
FIG. 9A is a side view of a transporting device according to the first embodiment, seen from a direction which is orthogonal to the transporting direction of the sheet of paper.
Figure 9B:
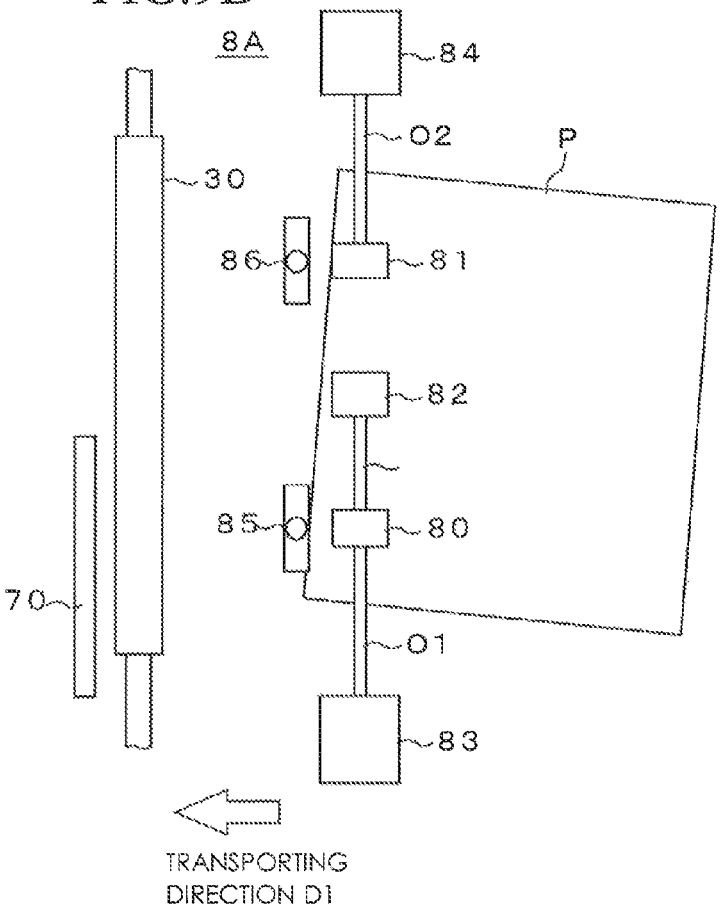
FIG. 9B is a plan view thereof.
Figure 9C:
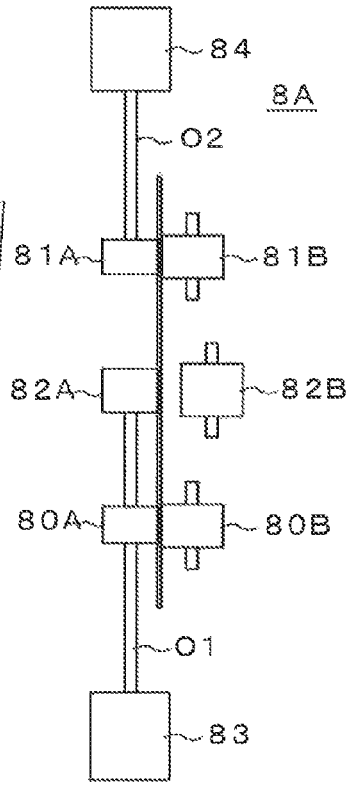
FIG. 9C is a front view thereof, seen from a direction which is parallel to the transporting direction of the sheet of paper, these drawings showing operation example of the transporting device when performing the second positional deflection correction control (part one)
Figure 10A:
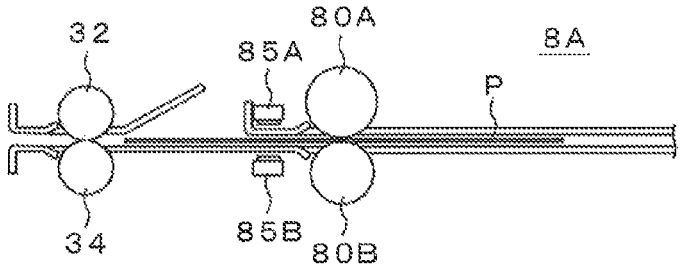
FIG. 10A is a side view of a transporting device according to the first embodiment, seen from a direction which is orthogonal to the transporting direction of the sheet of paper.
Figure 10B:
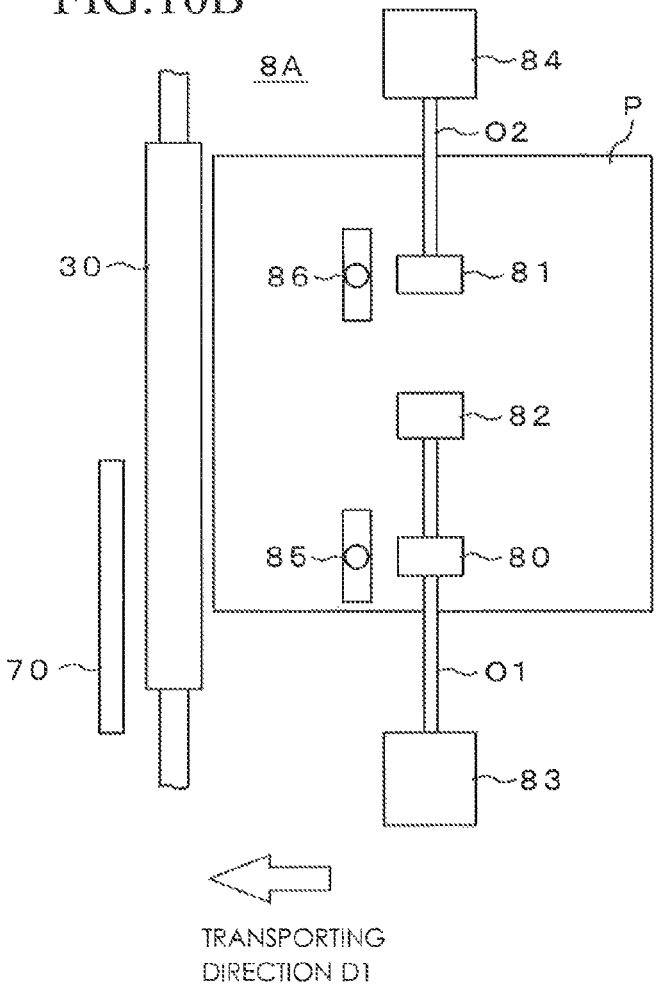
FIG. 10B is a plan view thereof.
Figure 10C:
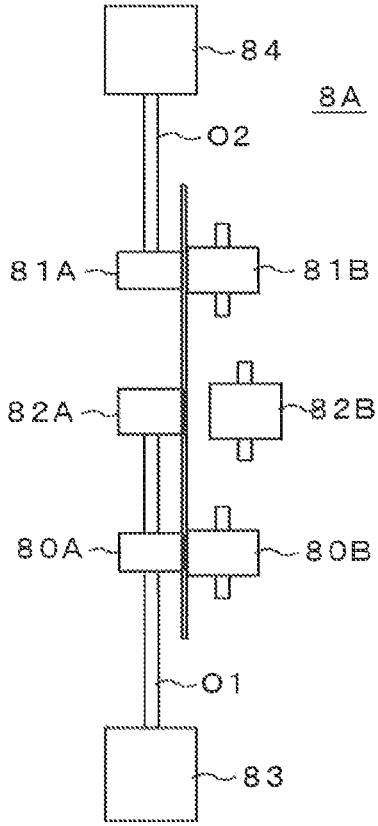
FIG. 10C is a front view thereof, seen from a direction which is parallel to the transporting direction of the sheet of paper, these drawings showing operation example of the transporting device when performing the second positional deflection correction control (part two)

On the other hand, if the controller 50 determines that the width of the sheet of paper P exceeds the previously set width W1 of the reference sheet of paper, the controller 50 performs the second positional deflection correction control of the sheet of paper. At the step S140, the controller 50 allows the steering-roller-driven rollers 80B, 81B to come into contact with the steering-roller-driving rollers 80A, 81A under pressure. As shown in FIG. 9C, the controller 50 controls the steering-roller-contacting mechanism 87 so that tire steering-roller-driven rollers 80B, 81B come into contact with the steering-roller-driving rollers 80A, 81A under pressure and controls the center-roller-contacting mechanism 88 to release the contact between the center-roller-driving roller 82A and the center-roller-driven roller 82B. This enables the sheet of paper P to be nipped by the steering-roller-driving rollers 80A, 81A and the steering-roller-driven roller 80B, 81B, as shown in FIGS. 9A through 9C. Under this condition, the controller 50 drives the steering-roller-driving motors 83, 84 to rotate the steering rollers 80, 81 so that the steering rollers 80, 81 become the same speed, thereby transporting the sheet of paper P to the shift roller 30. The controller 50 then goes to Step S150.

At the step S150, the controller 50 determines if the sheet of paper P is a sheet of paper for OHP (transparent sheet of paper). For example, the controller 50 determines if the sheet of paper P is a sheet of paper for OHP based on a detected result of the transparent-body-detecting sensor 90 disposed upstream from the steering rollers 80, 81 along the transporting direction D1 of the sheet of paper P. If it is determined that the sheet of paper P is a sheet of paper for OHP, the controller 50 goes to the step S120. If it is determined that the sheet of paper P is not a sheet of paper for OHP, namely, a common sheet of paper, the controller 50 goes to step S160.

If it is determined that the sheet of paper P is a sheet of paper for OHP, at the step S120, as described above, the positional deflection of the sheet of paper P is corrected by thrusting the forward end of the sheet of paper P against the shift roller 30 and forming the loop Rp. Thus, even if the sheet of paper has a width which exceeds the width W1 of the reference sheet of paper, the controller 50 performs the first positional deflection correction control of the sheet of paper when the deflection-detecting sensors 85, 86 are transmission sensors and the sheet of paper P is made of transparent material.

On the other hand, if it is determined that the sheet of paper P is not a sheet of paper for OHP, at the step S160, the controller 50 performs the positional deflection correction control of the sheet of paper P using the steering rollers 80, 81. As shown, in FIGS. 10A through 10C, the controller 50 maintains that the steering-roller-driven rollers 80B, 81B come into contact with the steering-roller-driving rollers 80A, 81A under pressure and performs the positional deflection correction control of the sheet of paper P by adjustably driving the steering-roller-driving motors 83, 84 separately to accelerate or decelerate the steering rollers 80, 81 with their difference in speed on the basis of the periods of time at two positions through which the sheet of paper P passes, detected by the detection of the deflection-detecting sensors 85, 86. Under such a series of operations, the controller 50 switches between the first positional deflection correction control of the sheet of paper and the second positional deflection correction control of the sheet of paper. The controller 50 then goes to the step S 130.

Figure 11A:
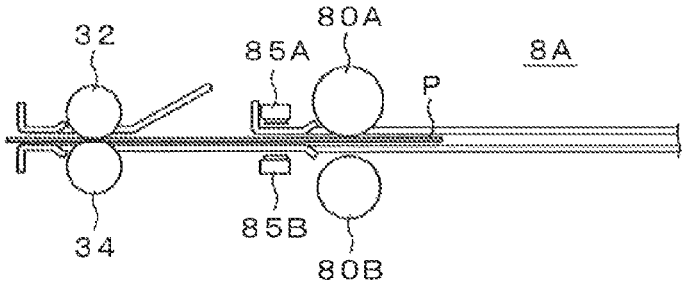
FIG. 11A is a side view of a transporting device according to the first embodiment, seen from a direction which is orthogonal to the transporting direction of the sheet of paper.
Figure 11B:
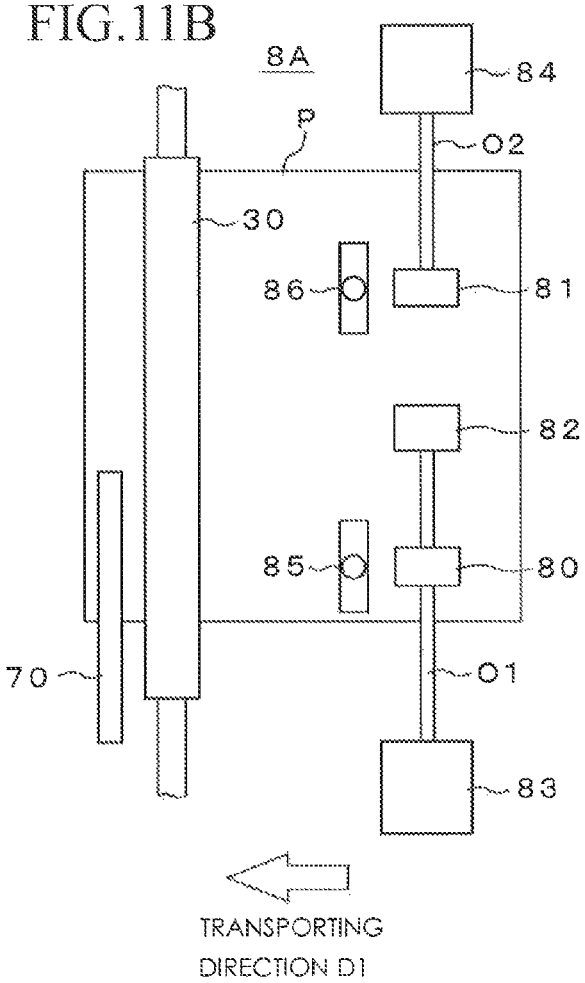
FIG. 11B is a plan view thereof.
Figure 11C:
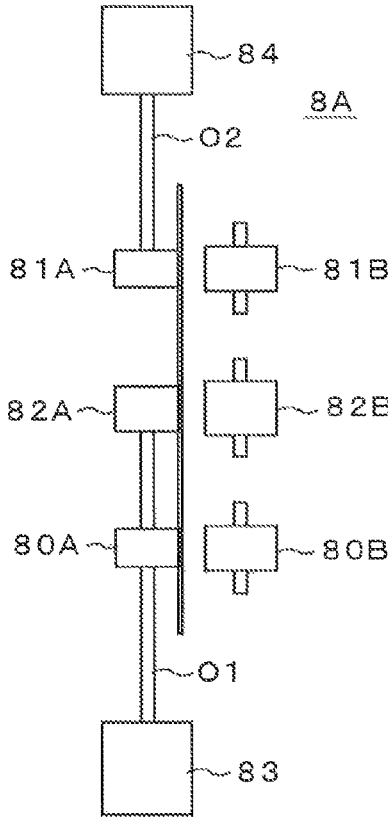
FIG. 11C is a front view thereof, seen from a direction which is parallel to the transporting direction of the sheet of paper, these drawings showing operation example of the transporting device when performing the second positional deflection correction control (part three)

At the step S130, the controller 50 performs the third positional deflection correction control of the sheet of paper, namely, deviation correction control of the sheet of paper P. The controller 50 drives the steering-roller-driving motors 83, 84 to transport the sheet of paper P, which is nipped by the shift roller 30, and then, stops driving the steering-roller-driving motors 83, 84. As shown in FIGS. 11A through 11C, the controller 50 controls the steering-roller-contacting mechanism 87 to release the contact between the steering-roller-driving rollers 80A, 81A and the steering-roller-driven rollers 80B, 81B. This enables the contact between the center-roller-driving roller 82A and the center-roller-driven roller 82B to be released and enables the contact between the steering-roller-driving rollers 80A, 81A and the steering-roller-driven rollers 80B, 81B to be released. When releasing the contacts therebetween, the controller 50 calculates an amount of deviation of the sheet of paper P in relation to the normal image forming position based on the detected result of the line sensor 70 and controls the shift roller 30 to move along a width direction of the sheet of paper P based on the calculated amount of deviation of the sheet of paper P to correct the deviation of the sheet of paper P.

As described above, according to the first embodiment of the transporting device and the image forming apparatus, when using the sheet of paper P which has a width that is narrower than the width W1 of the reference sheet of paper, the detection by the detection of the deflection-detecting sensors 85, 86 is not used. In other words, the second positional deflection correction control of the sheet of paper by the steering rollers 80, 81 is not performed but the first positional deflection correction control, of the sheet of paper by the center roller 82 is performed. Accordingly, the deflection-detecting sensors 85, 86 may be disposed corresponding to the sheet of paper P which has a wide width so that it is possible to perform the positional deflection correction of the sheet of paper unless the detection accuracy of the sheet of paper P which has a wide width by the deflection-detecting sensors 85, 86 is deteriorated.

Since the large-sized sheet of paper P having a width which is wider than the width W1 of the reference sheet of paper is not thrust against the shift roller 30 to form the loop, it is not necessary to stop transporting the sheet of paper P temporarily when thrusting it. This may prevent productivity thereof from being deteriorated. On the sheet of paper P having a width which is narrower than the width W1 of the reference sheet of paper, the deviation of the sheet of paper P may be corrected, as in the past, by performing the third positional deflection correction control of the sheet of paper using the shift roller 30.

Further, since the sensors of transmission type are used as the deflection-detecting sensors 85, 86, it is possible to detect the passage of the sheet of paper P accurately and to improve the accuracy of the positional deflection correction of the sheet of paper P. It is possible to reduce numbers of the parts to be used as the deflection-detecting sensors 85, 86 and the steering rollers 80, 81 in comparison with the past ones, which enables the costs in the image forming apparatus 100 to be reduced and enables a design thereof to be easily realized.

Second Embodiment

Although the first positional deflection correction has been performed using the center roller 82 in the first embodiment, the second embodiment is different from the first embodiment in that the first positional deflection correction is performed using the steering rollers 80, 81. It is to be noted that other components of the image forming apparatus 100 in this embodiment are identical to those of the first embodiment so that the identical components are indicated by the same reference numbers, a detailed explanation of which will be omitted.

Figure 12A:
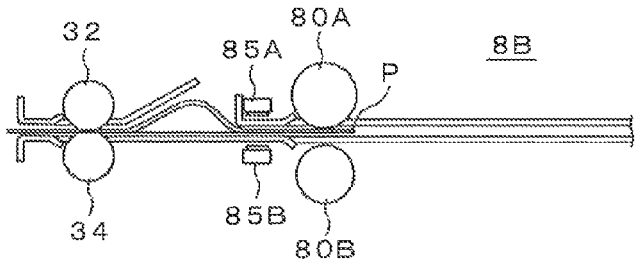
FIG. 12A is a side view of a transporting device according to a second embodiment, seen from a direction which is orthogonal to the transporting direction of the sheet of paper.
Figure 12B:
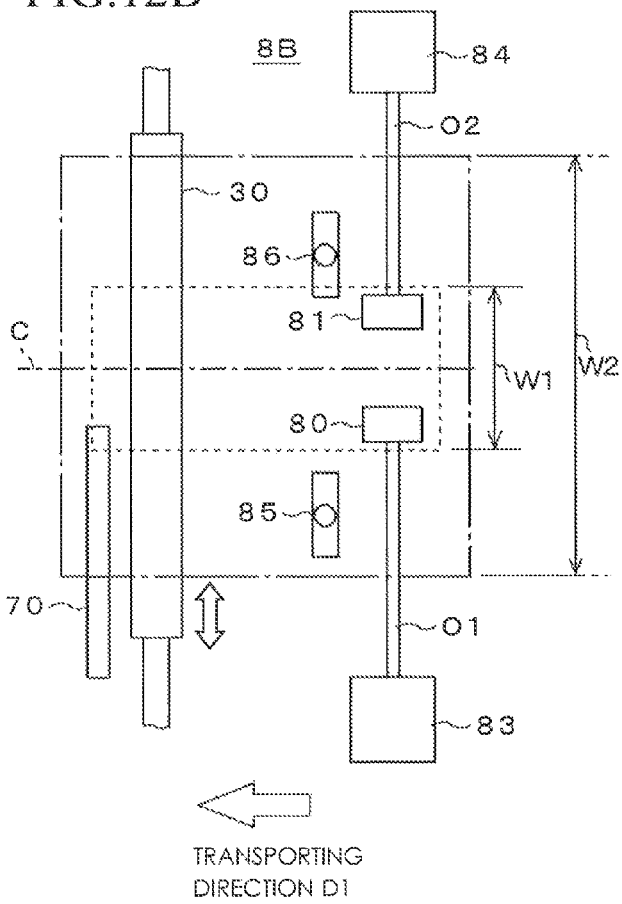
FIG. 12B is a plan view thereof.
Figure 12C:
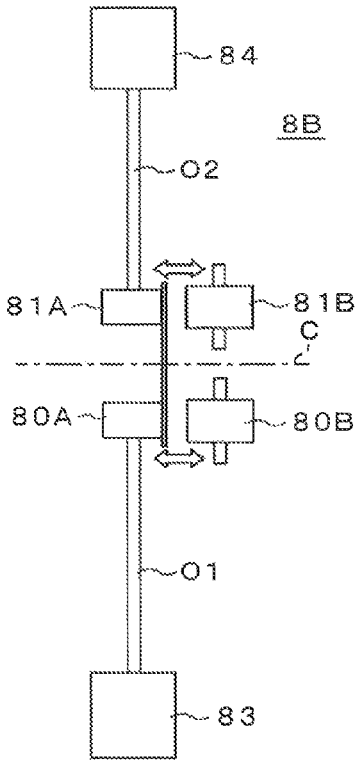
FIG. 12C is a front view thereof, seen from a direction which is parallel to the transporting direction of the sheet of paper, these drawings showing a configuration example of the transporting device according to the second embodiment in the image forming apparatus.

FIG. 12A shows a side view of a transporting device 8B according to the second embodiment, seen from a direction which is orthogonal to the transporting direction D1 of the sheet of paper P. FIG. 12B shows a plan view thereof. FIG. 12C shows a front view thereof, seen from a direction which is parallel to the transporting direction D1 of the sheet of paper P. As shown in FIGS. 12A through 12C, the transporting device 8B is provided with a pair of the steering rollers 80, 81, the steering-roller-driving motors 83, 84, a pair of the deflection-detecting sensors 65, 86, the shift roller 30 and the line sensor 70.

The steering rollers 80, 81 are rollers used when performing the first and second positional deflection correction controls of the sheet of paper P. The steering rollers 80, 81 are away from each other having a predetermined space therebetween along a direction that is orthogonal to the transporting direction D1 of the sheet of paper P in symmetry of a center criterion C of the transporting path of the sheet of paper P. For example, the steering rollers 80, 81 are respectively disposed in the image forming apparatus 100 within a width of the sheet of paper P having the minimum width. The steering rollers 80, 81 may transport the sheet of paper P having any sizes used in the image forming apparatus 100 with the sheet of paper P being nipped. The deflection-detecting sensors 85, 86 are respectively positioned within a region which is outside of the width W1 of the reference sheet of paper that is criterion when switching the positional deflection correction controls and inside of the width W2 of the sheet of paper P having the maximum size used in the image forming apparatus 100.

The controller 50 determines to perform the first positional deflection correction control of the sheet of paper or to perform the second positional deflection correction control of the sheet of paper based on the width of the sheet of paper P selected by the user in the operation display unit 62. When performing the first positional deflection correction control of the sheet of paper, the controller 50 controls the steering-roller-contacting mechanism 87 so that the steering-roller-driven rollers 80B, 81B come into contact with the steering-roller-driving rollers 80A, 81A under pressure. The controller 50 then drives the steering-roller-driving motor 83 to rotate the steering rollers 80, 81 at the same speed, thereby transporting the sheet of paper P having a width which is narrower than the width W1 of the reference sheet of paper to the shift roller 30 with the sheet of paper P being nipped. Accordingly, the positional deflection of the sheet of paper P is corrected by thrusting the forward end of the sheet of paper P against the shift roller 30 to form a loop Rp.

When performing the second positional deflection correction control of the sheet of paper, the controller 50 controls the steering-roller-contacting mechanism 87 so that the steering-roller-driven rollers 80B, 81B come into contact with the steering-roller-driving rollers 80A, 81A under pressure. The controller 50 then drives the steering-roller-driving motors 83, 84 separately with any difference in the speed corresponding to the periods of time of the passage of the sheet of paper P detected by the deflection-detecting sensors 85, 86 to rotate the steering rollers 80, 81, thereby performing the positional deflection of the sheet of paper P.

As described above, according the second embodiment, since the steering rollers 80, 81 to be used in the second positional deflection correction control of the sheet of paper are also used when performing the first positional deflection correction control of the sheet of paper without using the center roller 82, numbers of parts to be used may be reduced. As a result thereof, it is possible to reduce the costs in the image forming apparatus 100 and realise a simplified configuration thereof.

This invention is applicable to the transporting device which is capable of correcting the positional deflection of the sheet of transporting paper with high accuracy and low costs and the image forming apparatus using the same.

Although the present invention has been described with reference to the embodiments above, it is to be noted that the present invention is not limited to the embodiments, and various changes and modifications are possible to those who are skilled in the art. For example, although the shift roller 30 has corrected the positional deflection of the sheet of paper P by thrusting the sheet of paper P against it and the deviation of the sheet of paper P by moving along the direction that is orthogonal to the transporting direction D1 of the sheet of paper P in the above-mentioned embodiments, the shift rollers may be provided as to have separate mechanisms therefor.

Further, although the second positional deflection correction control of the sheet of paper has been performed on the sheet of paper P having the width that exceeds the width W1 of the reference sheet of paper, this invention is not limited thereto. For example, even if the sheet of paper P has the width that exceeds the width W1 of the reference sheet of paper, the deflection-detecting sensors 85, 86 cannot detect an amount of the positional deflection of the forward end of the sheet of paper P when notch(s) is (are) cut in the forward end of the sheet of paper and correspond(s) to the positions of the deflection-detecting sensors 85, 86. Therefore, if the second positional deflection correction control of the sheet of paper is performed, it is impossible to perform the positional deflection correction of the sheet of paper. Accordingly, in this case, the first positional deflection correction control of the sheet of paper is performed and the forward end of the sheet of paper P is thrust against the shift roller 30 so that it is possible to perform the positional deflection correction of the sheet of paper. In this moment, the controller 50 may obtain a method for the positional deflection correction control of the sheet of paper, under the selection by the user and then, determines to perform the first positional deflection correction control of the sheet of paper or to perform the second positional deflection correction control of the sheet of paper.

It should be understood by those skilled in the art that various modifications, combinations, sub-combinations and alterations may occur depending on design requirements and other factors insofar as they are within the scope of the appended claims or the equivalents thereof.

What is claimed is:

1. A transporting device that transports a sheet of paper comprising:

a pair of first roller members which is disposed along a second direction, the second direction being orthogonal to a first direction along which the sheet of paper is transported, and the first roller members being away from each other having a predetermined space therebetween along the second direction;

a pair of detection units that detects the sheet of paper passing through positions on which the detection units are disposed, the detection units being positioned downstream from the first roller members along the first direction and being away from each other having a predetermined space therebetween along the second direction;

a second roller member that is disposed downstream from the pair of the detection units along the first direction; and a control unit that controls operations of the first and second roller members, wherein the control unit switches between a first positional deflection correction control of the sheet of paper and a second positional deflection correction control of the sheet of paper based on a length of the sheet of paper along the second direction, the first positional deflection correction control correcting the positional deflection of the sheet of paper by thrusting a forward end of the sheet of paper against the second roller member, and the second positional deflection correction control correcting the positional deflection of the sheet of paper by rotating the respective first roller members separately based on periods of time detected by the defection units on the passing sheet of paper.

2. The transporting device according to claim 1 wherein the control unit performs the first positional deflection correction control when the length of the sheet of paper along the second direction is shorter than a length of the reference sheet of paper along the second direction, the length of the reference sheet of paper being set previously.

3. The transporting device according to claim 2 wherein the length of the reference sheet of paper along the second direction is equal to or longer than a length between the detection units.

4. The transporting device according to claim 2 wherein the pair of the roller members is disposed inside both ends of the reference sheet of paper along the second direction, and the control unit drives the first roller members to transport the sheet of paper when performing the first and second positional deflection correction controls.

5. The transporting device according to claim 1 further comprising a transparent body detection unit that detects whether or not the sheet of paper is a transparent body when the detection units are transmission sensors, wherein the control unit performs the first positional deflection correction control when based on the detection result of the transparent body detection unit, the control unit determines that the sheet of paper is a transparent body.

6. The transporting device according to claim 1 further comprising a third roller member which is disposed on a position corresponding to almost a middle of a reference sheet of paper, wherein the control unit drives the third roller member to transport the sheet of paper to the second roller member when performing the first positional deflection correction control.

7. The transporting device according to claim 6 wherein each of the first roller members includes a driving roller and a driven roller, the third roller member includes a driving roller and a driven roller, and the control unit releases a contact between the driving roller and the driven roller of each of the first roller members and brings the driven roller of the third roller member coming into contact with the driving roller of the third roller member under pressure when performing the first positional deflection correction control.

8. The transporting device according to claim 6 wherein each of the first roller members includes a driving roller and a driven roller, the third roller member includes a driving roller and a driven roller, and the control unit brings the driven roller of each of the first roller members coming into contact with the driving roller of each of the first roller members under pressure and releases a contact between the driving roller and the driven roller of the third roller member when performing the second positional deflection correction control.

9. The transporting device according to claim 1 wherein the second roller member includes a driving roller and a driven roller, and the control unit performs a third positional deflection correction control of the sheet of paper by moving the second roller member toward the second direction with the sheet of paper being held between the driving roller and the driven roller after the first or second positional deflection correction control is performed.

10. The transporting device according to claim 9 wherein each of the first roller members includes a driving roller and a driven roller, the third roller member includes a driving roller and a driven roller, and the control unit releases a contact between the driving roller and the driven roller of each of the first roller members and releases a contact between the driving roller and the driven roller of the third roller member when performing the third positional deflection correction control.

11. An image forming apparatus comprising:

an image forming device that forms an image on a sheet of paper; and a transporting device that transports the sheet of paper, the transporting device includes:

a pair of first roller members which is disposed along a second direction, the second direction being orthogonal to a first direction along which the sheet of paper is transported, and the first roller members being away from each other having a predetermined space therebetween along the second direction;

a pair of detection units that detects the sheet of paper passing through positions on which the detection units are disposed, the detection units being positioned downstream from the first roller members along the first direction and being away from each other having a predetermined space therebetween along the second direction;

a second roller member that is disposed downstream from the pair of the detection units along the first direction; and a control unit that controls operations of the first and second roller members, wherein the control unit switches between a first positional deflection correction control of the sheet of paper and a second positional deflection correction control of the sheet of paper based on a length of the sheet of paper along the second direction, the first positional deflection correction control correcting the positional deflection of the sheet of paper by thrusting a forward end of the sheet of paper against the second roller member, and the second positional deflection correction control correcting the positional deflection of the sheet of paper by rotating the respective first roller members separately based on periods of time detected by the detection units on the passing sheet of paper.

12. The image forming apparatus according to claim 11 wherein the control unit performs the first positional deflection correction control when the length of the sheet of paper along the second direction is shorter than a length of a reference sheet of paper along the second direction, the length of the reference sheet of paper being set previously.

13. The image forming apparatus according to claim 12 wherein the length of the reference sheet of paper along the second direction is equal to or longer than a length between the detection units.

14. The image forming apparatus according to claim 12 wherein the pair of the roller members is disposed inside both ends of the reference sheet of paper along the second direction, and the control unit drives the first roller members to transport the sheet of paper when performing the first and second positional deflection correction controls.

15. The image forming apparatus according to claim 11 wherein the transporting device further comprises a transparent body detection unit that defects whether or not the sheet of paper is transparent when the detection units are sensors of transmission type, wherein the control unit performs the first positional deflection correction control when based on the detection result of the transparent body detection unit, the control unit determines that the sheet of paper is transparent.

16. The image forming apparatus according to claim 11 wherein the transporting device further comprises a third roller member which is disposed on a position corresponding to almost a middle of a reference sheet of paper, wherein the control unit drives the third roller member to transport the sheet of paper to the second roller member when performing the first positional deflection correction control.

17. The image forming apparatus according to claim 16 wherein each of the first roller members includes a driving roller and a driven roller, the third roller member includes a driving roller and a driven roller, and the control unit releases a contact between the driving roller and the driven roller of each of the first roller members and brings the driven roller of the third roller member coming into contact with the driving roller under pressure when performing the first positional deflection correction control.

18. The image forming apparatus according to claim 16 wherein each of the first roller members includes a driving roller and a driven roller, the third roller member includes a driving roller and a driven roller, and the control unit brings the driven roller of each of the first roller members coming into contact with the driving roller of each of the first roller members under pressure and releases a contact between the driving roller and the driven roller of the third roller member when performing the second positional deflection correction control.

19. The image forming apparatus according to claim 11 wherein the second roller member includes a driving roller and a driven roller, and the control unit performs a third positional deflection correction control of the sheet of paper by moving the second roller member toward the second direction with the sheet of paper being held between the driving roller and the driven roller after the first or second positional deflection correction control is performed.

20. The image forming apparatus according to claim 19 wherein each of the first roller members includes a driving roller and a driven roller, the third roller member includes a driving roller and a driven roller, and the control unit releases a contact between the driving roller and the driven roller of each of the first roller members and releases a contact between the driving roller and the driven roller of the third roller member when performing the third positional deflection correction control.

* * * * *